United States Patent [19]

Zimmerman

[11] Patent Number: 4,563,161

[45] Date of Patent: Jan. 7, 1986

[54] SUBMERSIBLE TOY

[76] Inventor: Jack I. Zimmerman, Box 317 Rte. 1, Putnam Valley, N.Y. 10579

[21] Appl. No.: 619,547

[22] Filed: Jun. 11, 1984

Related U.S. Application Data

[63] Continuation-in-part of Ser. No. 540,269, Oct. 11, 1983.

[51] Int. Cl.[4] ..... A63H 23/00

[52] U.S. Cl. ..... 446/156; 446/199

[58] Field of Search ..... 446/156, 179, 161, 153, 446/159, 160, 163, 176, 180, 186, 187, 211, 199

[56] References Cited

U.S. PATENT DOCUMENTS

| | | | |
|---|---|---|---|
| 1,659,129 | 2/1928 | Asaro | 446/156 |
| 2,708,810 | 5/1955 | Canto et al. | 446/161 |
| 2,791,062 | 5/1957 | Hirsch et al. | 446/156 |
| 3,104,496 | 9/1963 | Macks | 446/199 |
| 3,870,309 | 3/1975 | Tessier | 446/179 X |
| 4,199,142 | 4/1980 | Reick | 446/179 X |

*Primary Examiner*—Mickey Yu

*Attorney, Agent, or Firm*—Howard I. Podell

[57] ABSTRACT

This invention resides in improvements in a toy and particularly in a toy which may, in use, cyclically rise and sink in water due to the change of buoyancy caused by bubbles formed in a lower internal chamber in which moistened baking powder or the like may be placed. An upper section of the toy is fitted with one or more hollow tubular sections that serve to suspend the toy in a generally erect position when initially fully immersed in water and which tubular sections serve as a pivot about which the toy oscillates as it rises and sinks. The tubular sections are generally formed with a hollow interior section that communicates to an open mouth section of a size to retain air within the interior when the object is immersed in water. The toy may be employed out of the water to slide down an inclined ramp as formed bubbles momentarily lift the toy off an inclined surface of the ramp.

7 Claims, 14 Drawing Figures

SUBMERSIBLE TOY

This application is a continuation-in-part of U.S. Patent Application 540,269, entitled "Toy Submarine" filed on Oct. 11, 1983 by the same inventor.

FIELD OF THE INVENTION

This invention relates generally to a shaped toy which repeatedly rises and submerges in water.

STATEMENT OF THE PRIOR ART

The prior art, as exemplified by U.S. Pat. Nos. 4,052,812; 1,318,049; and 2,712,710 is generally illustrative of various devices of this type. While such devices are usually acceptable for their intended purposes, they have not proven to be entirely satisfactory in that they are either complex and expensive to manufacture, or bulky and inconvenient to use, or to operate. As a result of the shortcomings of the prior art, typified by the above , there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction.

Other objects of this invention will in part be obvious and in part hereinafter pointed out.

SUMMARY OF THE INVENTION

This invention resides in improvements in a toy and particularly in a shaped toy which cyclically rises and sinks in water due to the change of buoyancy caused by bubbles formed in an internal chamber in which baking powder or the like is placed. The bubbles are formed as water moistens the powder, and the effect of the gas bubbles is to force water from the chamber out through the same hole, so as to increase the buoyancy of the toy. Once the toy rises to the surface, the toy tips to release the bubble, permitting water to again enter the chamber and the toy a special composition so as to be of a slightly greater density than water and to consequently eliminate the need for ballast material of a different composition than the molded plastic. Consequently the separate members of the toy, or the entire toy can be molded simultaneously as one piece and separated at breakaway joints.

An important advantage of my invention lies in the particular design of the elements that make up the chamber so as to provide improved ease to a child-user in loading baking powder into the chamber.

A further important advantage of my invention lies in the design of the toy so that the toy will repeatedly perform specific movements in cyclically rising to the surface and sinking, in use, and that such movements may lend character to the specific shape of the toy. Thus a toy shaped as a sea horse or a dolphin may be so designed that it will make rocking motions, in use, suggestive of such sea creatures.

A further advantage of my invention is that it may be formed with tubular projections, open at one end, which serve to enhance the buoyancy of the toy while under water, by entrapping fixed air bubbles during initial immersion of the toy in water so as to assist in the rising action of the toy, while such sections loose the the bulk of their bouyancy effect when the open ends of the tubular projection breach the surface of the water.

DESCRIPTION OF THE BEST MODE OF THE INVENTION

Figure 2:
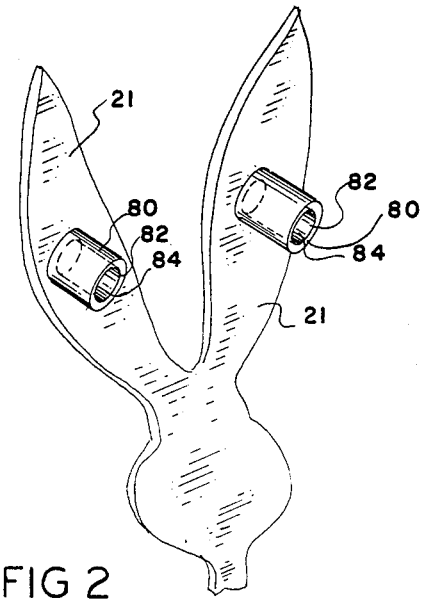
FIG. 2 is a detail rear perspective view of the upper section of the toy.
Figure 1:
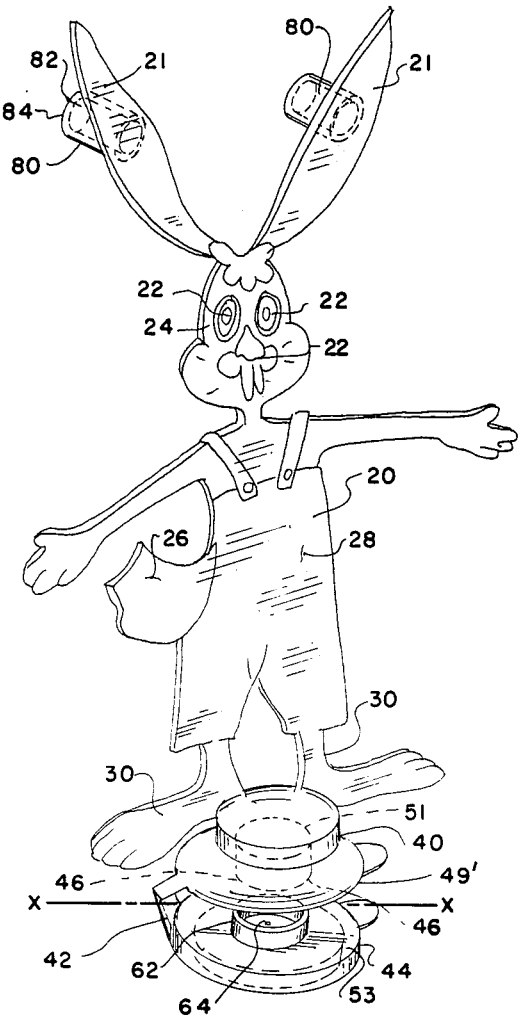
FIG. 1 is a perspective view of the invention, taken from the front of the toy.
Figure 3:
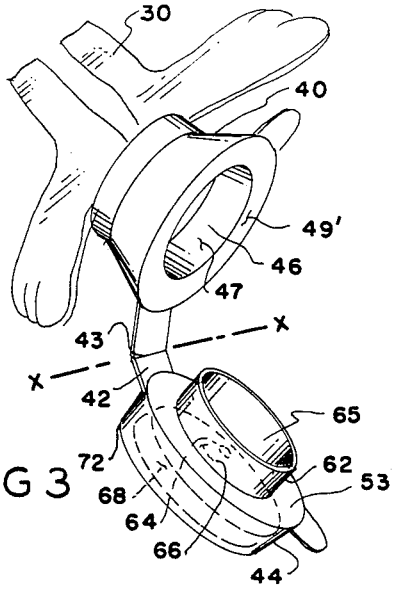
FIG. 3 is a detail front perspective view of the lower section of the toy.

Turning now descriptively to the drawings, in which similar reference characters denote similar elements through out the several views, FIGS. 1–11 illustrate toys constructed in accordance with the principles of the invention. Referring descriptively to FIG. 1–3, the toy 10 is a one-piece molding of a plastic material of slightly greater specific gravity than water, preferably such as a specific gravity of 1.2. The upper section 20 is shaped as a rabbit with two ear sections 21 each projecting upwards, with facial markings 22 embossed on the front side of the face section surface 24, with a tail section 26 projecting rearwards from the lower rear side of body section 28. Legs 30 are fixed to a cylindrical base section 40 which is joined by a hinge section 42, pivotable about axis X—X to a cap unit 44.

A blind circular recess 46 is located within base 40 extending downwards to an open circular mouth 48 bounded by the bottom surface 49'. Recess 46 is formed with a uniform circular cross-section along its height from mouth 28 to upper recess wall 51.

Figure 8:
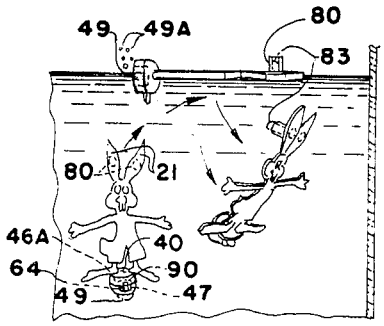
FIG. 8 is a front view illustrating the action of the invention in use.

Cap unit 44 is of a general cylindrical shape of a diameter of base 40 and formed with a flat upper surface 53 from which a hollow circular tubular section 62 extends upwardly. The tubular section 62 of cap unit 44 is of a size and shape to matingly engage the inner circular wall 47 of base section 40 along their respective frictionally engaged vertical surfaces in a snug slidable detachable fit as shown in FIG. 8. A small vent hole 64 pierces the bottom wall 66 of the recess 65 formed by tubular section 62 and bottom wall 66, so that the recess 65 communicates with an external recess section 68 extending inwardly upwardly from the bottom surface 72 of cap unit 44 through said vent hole 64.

As shown in FIGS. 1,3 and 8, both base unit 40 and cap unit 44 are molded as an integral unit joined by hinge section 42 which is formed with a fold line 43 along axis X—X. As shown in FIG. 8, cap unit 44 and base unit 40 can be assembled together so that recess 65 and recess 46 form a common chamber 46A.

In use, a small heap of baking powder 90 is initially placed in recess 65 and moistened with water while the cap unit 44 is in the open position of FIG. 1. and the cap unit assembled to fit the base unit. with the toy then immersed in water as shown in FIG. 8.

The toy may be positioned so that cap unit 44 is inverted so that tubular section 62 projects downwards and tubular section 62 is then manually pressed one or more times against powder 90 on a surface 95 so as to readily pack a quantity of powder 90 into the interior recess 65 of tubular section 62, and without the need for the user to otherwise directly touch powder 90. The cap unit is then re-inverted to the position in which tubular section 62 extends upwards and one or more drops of water are dripped onto the powder or the powder is moistened in any other suitable manner. The base 40 is now engaged by cap unit 44 by manually inserting tubular section 62 into recess 46, and the assembled toy 10 is placed into water in the upright position. As the toy slowly sinks, the baking powder produces a gas bubble 49 of carbon dioxide which is vented downwards through vent 64 into external recess 68. Water is consequently displaced by the carbon dioxide bubble in recess 68, gradually increasing the buoyancy of the toy. Once sufficient water in recess 68 has been displaced by the increased volume of the growing bubble, the toy begins to rise until it reaches the surface. Instability of the toy and bubble system causes the toy to tip as it reaches the surface of the water, and the carbon dioxide bubble breaks off and escapes into the atmosphere from external recess 68. The toy now sinks and the cycle repeats.

The initial negative buoyancy of the toy determines the period of this cycle. The user can adjust the initial buoyancy by regulating the extent to which tubular section 62 extends into recess 46 of section 40, since the engaged sections will snugly hold together over a range of fits to vary the volume of chamber 46A, with the initial buoyancy of the toy directly proportional to the size of chamber 46A.

Figure 9:
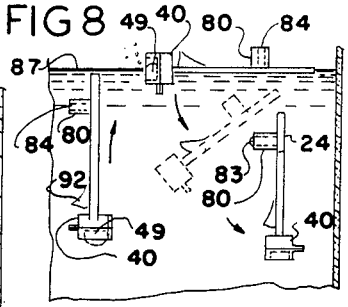
FIG. 9 is a detail side view of the action of the invention in use.

As shown in FIGS. 1 & 2, a tubular projection 80 extends to the rearwards of each of the two ear sections 21. Each projection 80 is formed with an internal hollow tubular blind recess 82, with an open mouth section 84 so that the recess 82 is open at to the exterior via mouth section 84, with interior recess 82 bounded at its bottom wall 22 by the exterior ear section 21. Tubular projection 80 is of a diameter so that the cross-section of recess 82 and open mouth section 84 are each of a size to retain air as a bubble 83 from the atmosphere when the toy is immersed in water, in use. The length that the blind recess 82 extends in projection 80 from bottom wall 22 to mouth section 84 and the cross-section area of blind recess 82 govern the volume of the retained air bubble 83. Air bubble 83 produces a buoyancy effect which results in the causing the toy to oscillate in a vertical plane as if pivoting from the upper end of the toy to which the projections 80 are mounted as the toy rises in immersed water as shown in FIGS. 8,9 from the vertical position at A towards a horizontal position at B at the surface of the water.

Since the total density of the tubular section 80 when filled with air bubble 83 is less than that of water, the tubular section serves to "lift" the toy into the vertical position when totally immersed, with the toy rising when there is a sufficiently large carbon dioxide bubble 49 in recess 68 so that the total density of the toy and bubbles is less than that of the water.

The projections 80 when filled with air bubble 83 remain elevated as the toy reaches the surface 87 of water and causes the rear flat side to become uppermost as the toy now assumes a horizontal position at position B parallel to water surface 87. A tail section 92, or other decorative projection which extends from the rear surface of the toy will now project upwards to the amusement of the user. Once the carbon dioxide bubble 49 escapes, at position B, the base section 40 becomes heavier than the water and starts to fall downwards into the water, causing the toy to oscillate in pendulum fashion about head section, since tubular projections 80 retain the captive air bubble 83 due to the limited size of mouth opening 84 and the surface tension of the water, and thus the tubular sections 80 contribute lift to the sinking toy, so as to "hang" it in a generally erect position as the toy base oscillates laterally. The cycle repeats as a new carbon dioxide gas bubble 49 is formed by the action of the baking powder in recess 46A with the toy oscillating as it again rises, as if it were pivoted about projections 80. As many as 30 cycles will occur with one filling of fresh baking powder in recess 46A. While this embodiment of the invention is shown with two projections 80 extending from the same side of the toy, the unusual effect of the invention may be achieved with only one, or with three or more such projections.

In general, the maximum size of the mouth opening 84 must be limited to prevent the entrapped air bubble 83 from escaping. I have found that a circular mouth opening of one-eighth of an inch diameter results in air bubble 83 being permanently entrapped in recess 82 when the toy is fully immersed in water, with the plane of the mouth opening and the body section both extending in the vertical plane. When the tube extends along a generally horizontal axis, with the projection 80 mounted along a generally vertical axis, a larger cross-section of hollow interior and mouth section may be provided without loss of entrapped air in the tubing recess 82. The volume of recess 82 in relation to the wall thickness of the projection 80 determines the magnitude of the lift effect of bubble 83 for a given cross-section of recess. While toy 10 is shown with two projections 80 mounted to a common side of the toy, such a toy can be made with one or more projections located on the same side and on the upper section of the toy.

Figure 4:
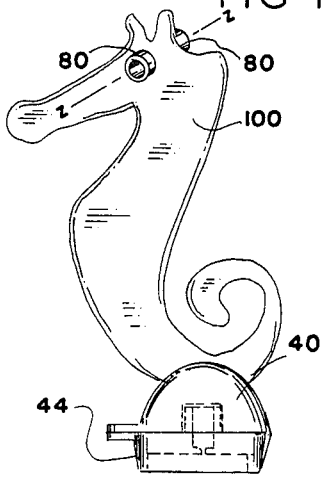
FIG. 4 is a front perspective view of an alternative form of the invention.
Figure 12:
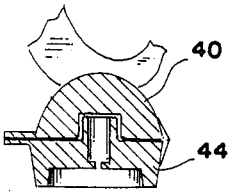
FIG. 12 is a detail sectional view of the alternative form of the invention.
Figure 6:
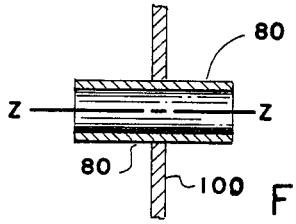
FIG. 6 is a detail side sectional view taken along axis Z—Z of FIG. 4.
Figure 10:
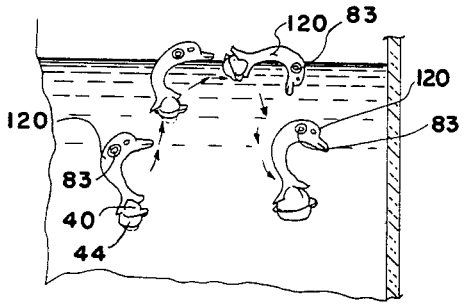
FIG. 10 is a detail front view illustrating the action of the invention in use.

A further embodiment of my invention is shown in FIGS. 4,6 and 10 in the form of a sea horse 100 formed of a flat shaped body section 105 mounted at its lower section to a base 40 fitted with cap unit 44, as in toy 10. Two projections 80 are mounted on an upper section of the toy, one on each side, and preferably along a common axis Z—Z. As in toy 100 each projection 80 encloses a blind recess 82 joined to an open exterior mouth opening 84 so that each projection entraps a bubble 83 of air when the toy is immersed. As shown in FIG. 10, the action of toy 100 is to rise to the surface, in the erect position as at A and A', and to rotate about axis Z—Z once the projections 80 have reached the surface, from the lift effect of the carbon dioxide bubble, with the toy then immersing as it looses the carbon dioxide bubble 49 upon reaching or approaching the water surface 87.

Since the oscillating action is in the plane of the flat body section 105, the oscillations will continue for several cycles as the toy sinks and then rises to provide an entertaining effect, particularly if the shape of the toy is in the form of sea horse 100 or dolphin 120 or other object in which a pivotable pendulum—type motion provides entertainment.

Figure 5:
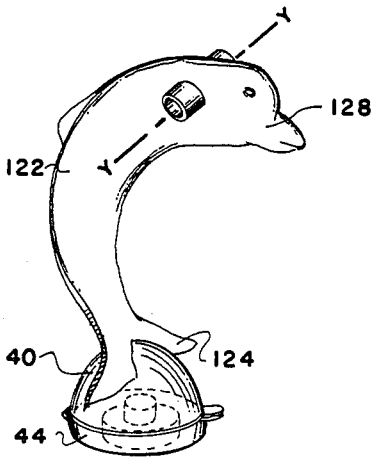
FIG. 5 is a front perspective view of a further alternative form of the invention.
Figure 7:
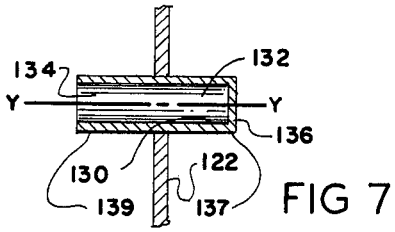
FIG. 7 is a detail side sectional view of the invention taken along axis Z—Z of FIG. 4.
Figure 11:
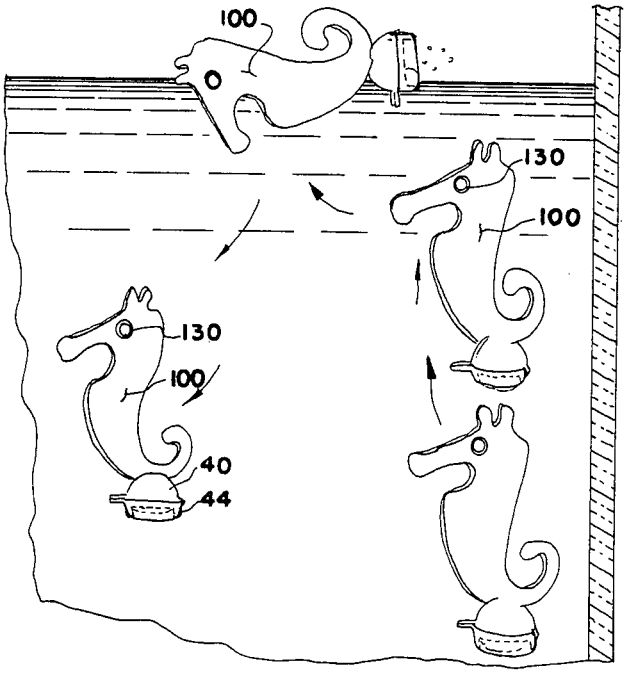
FIG. 11 is a detail front view of an alternative form of the invention, in use.

FIGS. 5,7 and 11 illustrate a still further embodiment of the toy in the form of dolphin 120 which is formed of a flat body section 122 in the general shape of a dolphin attached at its lower section 124 to a base 40 fitted to a cap unit 44 as previously described. Dolphin toy 120 is fitted with a through tube 130 of which the hollow interior section 132 is formed with an open mouth section 134 at at least one end of the tube. As shown in the embodiment of FIG. 7, the opposed end of the tube 130 is formed with a wall that forms a closed end wall 136 to interior section 132. Tube 130 extends along an axis Y—Y generally perpendicular to the plane of flat body section 122 and is mounted so as to extend on both sides of the upper head section 128. The action of tube 130 is retaining an entrapped bubble of atmospheric air, after immersion in water, is similar to that of tubes 80 of toy 100. Since the closed section 137 of tube 130 is heavier than the open section 139 extending from the other side of the body section, because of wall 136, section 137 should be made longer than section 139 so that when immersed in water and with air in the interior section 132, both sections 137 and 139 contribute equal lifting effects. However, should it be desired that the toy float at an angle to the vertical in the plane of flat body section 122, unequal lengths of sections 137 and 139 may be employed.

Both toys 100 and 120 may be formed with more than one set of tubes 80 or 130 extending on each side of the respective body section of the toy. In all toys 10, 100 and 120 tubes similar to those of tubes 80 or 130 may be employed in which the hollow interior section is completely sealed from the atmosphere. However such tubes would be more expensive to fabricate than a tube the interior of which is open to at least one end.

Figure 13:
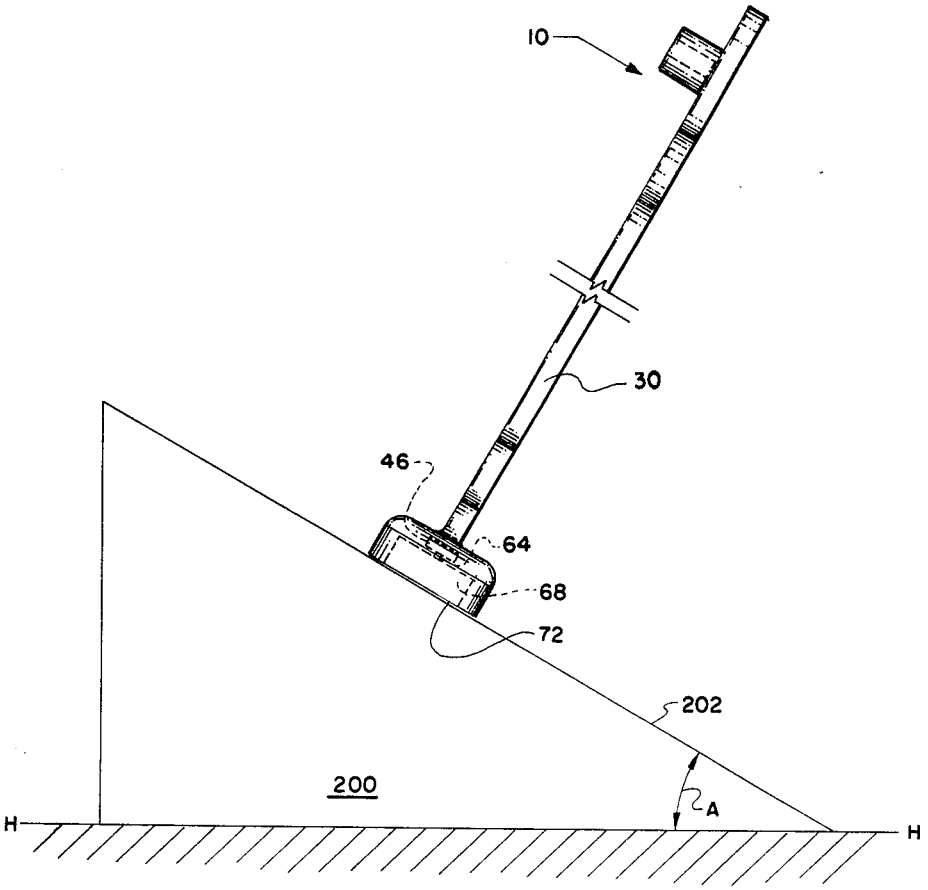
FIG. 13 is a side view of a still further emodiment of the invention.
Figure 14:
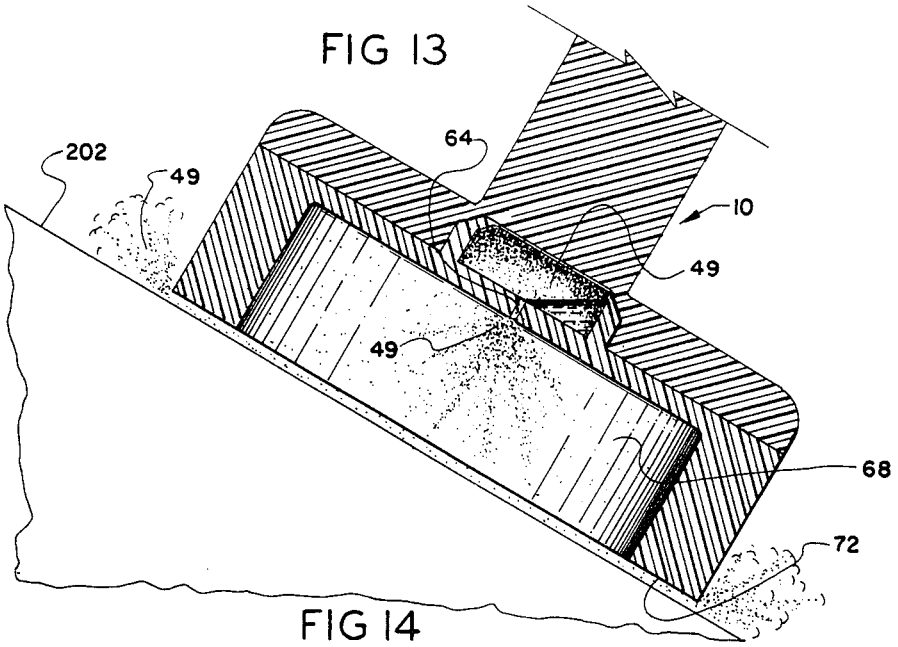
FIG. 14 is a detail side view of this embodiment in use.

My invention can also be employed completely out of water, as shown in FIGS. 13–14. The toy rabbit 10 simulates a waddling motion as it moves down an inclined ramp when the ramp and toy are completely out of water. For such purposes, a ramp 200 with a relatively flat surface 202 inclined by angle A, preferably 10 to 30 degrees, to the horizontal plane H—H of the bottom surface 203, serves as a base upon which the invention 10 is placed, after baking powder is added into the internal recess 46 at the base of the toy rabbit 10. One or more drops of water may be added to the baking powder in the recess, preferably before the cap unit 44 is closed, and the toy is then placed in an inclined erect position to stand upon inclined surface 202 of ramp 200.

The pressure of the bubbles of carbon dioxide gas, which are expelled from recess 46 through vent 64 into bottom external recess 68, serve to partially lift the toy off surface 202 primarily causing the erect toy 10 to tilt forwards releasing some of the carbon dioxide bubble 49 when it lifts a portion of the bottom surface 72 off of ramp base surface 202. The consequent bouncing motion of the toy momentarily reduces the friction between bottom surface 72 of the toy and ramp surface 202 and consequently the toy slides forwards and downwards until it either reaches the bottom of the ramp surface, or the bubbles cease to form. The angle A of ramp surface is chosen such that the static friction of a toy upon the surface 202 is sufficient to normally hold the toy in place on surface 202, such that the toy does not slide down the surface except when lifted momentarily by the bubbles.

The bouncing motion of the toy when sliding down the ramp 202 contributes to the illusion that the toy is moving under the action of its own feet 30.

I have found that I can inexpensively produce this toy if the entire assembly is produced from one material, since the costs of manufacturing and installing additional ballast parts of metal or other material is eliminated. Conventional plastic molding materials that are approved for use in a child's toy are lighter than water and their use would require an additional ballast of other material such as metal or vinyl plastic tubing. By employing a mix of polypropylene filled with 40%, by weight, of powdered calcium carbonate I have obtained a specific gravity of approximately 1.2 in the molded parts that form the two sections of the boat, thus eliminating the need for additional ballast material of a substance other than that from which the toy is fabricated in a one-step molding process The structure of the toy enables a child or other user to fill the recess 65 with powder and without the user physically directly touching the powder or otherwise causing it to disperse into the surrounding air, an important safety feature. Since tubular section 63 extends a substantial distance away from the remainder of base section 40 in the open position, the recess of section 62 is readily packed with powder when the cap unit 44 is inverted and the external face of section 62 pressed against a heap of powder lying on a surface or in a container. This powder packed recess then becomes part of or communicates with the internal chamber of the base in the assembled mode.

The device of the invention has been thoroughly tested under actual use conditions and has been found to be completely successful for the accomplishment of the above-stated objects of the present invention.

The operation and use of the invention hereinabove described will be evident to those skilled in the art to which it relates from a consideration of the foregoing.

It will thus be seen that there is provided a device in which the several objects of the invention are achieved, and which is well adapted to meet the conditions of practical use.

It is thought that persons skilled in the art to which this invention relates will be able to obtain a clear understanding of the invention after considering the foregoing description in connection with the accompanying drawing. Therefor, a more lengthy description is deemed unnecessary. It is understood that various changes in shape, size, and arrangement of the elements of this invention as claimed may be resorted to in actual practice, if desired.

Having thus described the invention, what I claim as new and desire to secure by Letters Patent of the United States is:

1. A toy article which is fitted with means to submerge the said toy article in water and to cyclically rise to the surface and then submerge again, in which said means comprise an internal chamber communicating by a vent hole to a recess open to the exterior of the said article, so that a moistened powder may be located within said chamber so as to form a gas bubble which flows through said vent into said recess to displace water out of said recess of said article and so increase the buoyancy of the article causing it to initially rise when in water, with the article then losing this increase of buoyancy after the said bubble further enlarges and detaches from the said article resulting in the article then again submerging in the water, in which said article is fitted with air suspension means to provide further buoyant effect to said article, said air suspension means serving to assist in the orientation of the article in various positions during the cycle of rising and submerging and to enable the article to oscillate with a pendulum—type motion during said cycle, where said air suspension means comprises a projection extending from the article, which projection is formed with a recess open to the exterior through an open mouth section of the projection, in which said recess and said mouth section is of a size and shape with relation to surface tension of water to prevent captive air in the said recess from escaping from the said recess while said projection is immersed in water regardless of the orientation of the said open mouth section when said projection is immersed in water, such that said air is entrapped in the said recess of the projection and acts to furnish lift to the article when the projection is so immersed.

2. The article of claim 1 in the shape of an animal, in which said air suspension means is mounted in a head section of the article, so as to maintain said head section in a generally erect position when the toy is fully immersed.

3. The article of claim 1 in the shape of a fish-like animal, in which said air suspension means is mounted in a head section of the article, so as to maintain said head section in a generally erect position when the toy is fully immersed, while serving as a pivot location for oscillation and to simulate the motion of a fish-like animal during the cycle.

4. The article of claim 1 in which a plurality of said projections are mounted to a common side of the article.

5. The article of claim 1 in which at least one said projection extends from each of two opposed sides of said article.

6. The article of claim 5 in which a said projection extends through the body section of said article to project from each of two opposed sides of said body section.

7. The article of claim 6 in which a length of said projection that extends from one side of the body section is of greater length than said projection that extends from the other and opposed body section, so as to provide for a differential in buoyancy effect of the air entrapped in the interior section of said tube on each side of the body section.

* * * * *